US006936966B2

(12) United States Patent
Kanazawa et al.

(10) Patent No.: US 6,936,966 B2
(45) Date of Patent: Aug. 30, 2005

(54) PLASMA DISPLAY DEVICE INCLUDING SPECIFIC SHAPE OF ELECTRODE

(75) Inventors: Yoshikazu Kanazawa, Kawasaki (JP); Seiki Kuroki, Higashimorokata (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 09/929,048

(22) Filed: Aug. 15, 2001

(65) Prior Publication Data

US 2002/0027413 A1 Mar. 7, 2002

(30) Foreign Application Priority Data

Sep. 1, 2000 (JP) ..... 2000-266042

(51) Int. Cl.[7] ..... H01J 17/49
(52) U.S. Cl. ..... 313/584; 313/582; 313/491
(58) Field of Search ..... 313/581–587, 313/484–485, 491, 631, 39, 632; 315/169.4; 345/60, 67; 445/24

(56) References Cited

U.S. PATENT DOCUMENTS

| | | | | |
|---|---|---|---|---|
| 5,640,068 A | | 6/1997 | Amemiya | |
| 6,232,717 B1 | * | 5/2001 | Oida et al. | 313/586 |
| 6,465,956 B1 | * | 10/2002 | Koshio et al. | 313/586 |
| 6,495,958 B1 | * | 12/2002 | Moon | 313/584 |
| 6,646,377 B2 | * | 11/2003 | Hashimoto | 313/582 |

FOREIGN PATENT DOCUMENTS

| | | | |
|---|---|---|---|
| EP | 1 017 081 | 7/2000 | |
| EP | 1 065 695 | 1/2001 | |
| JP | 9-160525 | 6/1997 | H01J/11/00 |
| JP | 9-237580 | 9/1997 | H01J/11/00 |
| JP | 2001-195431 | 7/2000 | H01J/11/00 |
| WO | WO 00/44025 | 7/2000 | |

OTHER PUBLICATIONS

Hirata, Shinzo, et al., "Characteristics of High Speed Addressability of Full–Color Surface–Discharge AC Plasma Display Panels", Hiroshima University, pp. 25–29, 1989, (no month).

* cited by examiner

*Primary Examiner*—Karabi Guharay
(74) *Attorney, Agent, or Firm*—Staas & Halsey LLP

(57) ABSTRACT

A plasma display device having first and second substrates and a discharge gas filled therebetween includes first and second electrodes extending parallel to each other on a first substrate, and first and second discharge electrode parts extending from the first and second electrodes, respectively, so as to oppose each other. A discharge gap of a substantially constant width is formed between one of the first discharge electrode parts and one of the second discharge electrode parts, the ones opposing each other, the discharge gap being defined by first and second edge parts of the ones of the first and second discharge electrode parts, respectively. The first and second edge parts have lengths longer than widths of the ones of the first and second discharge electrode parts, the widths being measured in directions in which the first and second electrodes extend, respectively.

17 Claims, 11 Drawing Sheets

PLASMA DISPLAY DEVICE INCLUDING SPECIFIC SHAPE OF ELECTRODE

BACKGROUND OF THE INVENTION

1. Field of the Invention

The present invention generally relates to flat-panel display devices, and more particularly to a plasma display device.

A plasma display device is a flat-panel display device of a light-emitting type that displays picture information by selectively inducing discharges in a gas filled between a pair of glass substrates.

It is important for the plasma display device to increase resolution and reduce power consumption at the same time.

2. Description of the Related Art

FIG. 1 is a diagram showing a basic structure of a conventional common plasma display device 10. A structure similar to this is disclosed in Japanese Laid-Open Patent Application No. 2000-195431.

The plasma display device 10 is basically defined by a display panel 11 and first through third driving circuits 12A through 12C that cooperate with the display panel 11. The display panel 11 includes first discharge electrodes $X_1$ through $X_m$ and second discharge electrodes $Y_1$ through $Y_m$ that are alternately arranged parallel to each other and extend in the X direction of FIG. 1. Further, the display panel 11 includes address electrodes $Z_1$ through $Z_n$ that extend in the $Y_1$ direction of FIG. 1 to intersect the first and second discharge electrodes $X_1$ through $X_m$ and $Y_1$ through $Y_m$. The first discharge electrodes $X_1$ through $X_m$, the second discharge electrodes $Y_1$ through $Y_m$, and the address electrodes $Z_1$ through $Z_n$ are selectively activated by the first through third driving circuits 12A through 12C, respectively.

For instance, an address voltage is applied between a selected one of the first discharge electrodes $X_1$ through $X_m$ ($X_2$ in FIG. 1) and a selected one of the address electrodes $Z_1$ through $Z_n$ ($Z_4$ in FIG. 1), so that a discharge is started between the first discharge electrodes $X_2$ and the address electrode $Z_4$. Next, by applying a discharge-sustaining voltage between the first discharge electrodes $X_2$ and the adjacent second discharge electrode $Y_2$ by the driving circuits 12A and 12B, a discharge is started between the first discharge electrodes $X_2$ and the second discharge electrode $Y_2$ in a display cell selected by the address electrode $Z_4$. The discharge is maintained while the selected display cell is activated.

It is required for such a plasma display device to increase resolution by narrowing pitches between electrodes and reduce power consumption at the same time.

FIG. 2 is a sectional view of the conventional plasma display panel 11, whose type is referred to as an ALIS (Alternate Lighting of Surfaces) type, taken along the Y direction of FIG. 1.

The display panel 11 of FIG. 2 is defined by glass substrates 11A and 11B opposed to each other, and a discharge gas is filled between the glass substrates 11A and 11B.

The glass substrate 11A may be referred to as a front or display-side substrate facing a viewer of the display panel 11, and the glass substrate 11B may be referred to as a rear substrate provided across the glass substrate 11A from the viewer.

More specifically, the glass substrate 11A has the first and second discharge electrodes $X_1$ through $X_m$ and $Y_1$ through $Y_m$ alternately arranged with the same pitch on its side opposing the glass substrate 11B. The glass substrate 11B has the address electrodes $Z_1$ through $Z_n$ formed on its side opposing the glass substrate 11A. The first and second discharge electrodes $X_1$ through $X_m$ and $Y_1$ through $Y_m$ are formed of a transparent conductive film of ITO ($In_2O_3 \cdot SnO_2$), and the first discharge electrodes $X_1$ through $X_m$ (ITO electrodes) has low-resistance bus electrodes $x_1$ through $x_m$ formed thereon, respectively. Similarly, the second discharge electrodes $Y_1$ through $Y_m$ (ITO electrodes) has low-resistance bus electrodes $y_1$ through $y_m$ formed thereon, respectively. On the other hand, the address electrodes $Z_1$ through $Z_n$ are formed of low-resistance metal patterns to extend in a direction to cross a direction in which the bus electrodes $x_1$ through $x_m$ or $y_1$ through $y_m$ extend. The first and second discharge electrodes $X_1$ through $X_m$ and $Y_1$ through $Y_m$ and the bus electrodes $x_1$ through $x_m$ or $y_1$ through $y_m$ are covered with a dielectric film 11*a* on the glass substrate 11A, and the address electrodes $Z_1$ through $Z_n$ are covered with a dielectric film 11*b* on the glass substrate 11B. Further, as is not shown in the drawing, fluorescent material patterns of red, green, and blue are applied and formed on the dielectric film 11*b* in accordance with display pixels.

In the display panel 11 of the above-described structure, discharges caused between the glass substrates 11A and 11B excite the fluorescent material patterns to produce light, which is emitted through the glass substrate 11A as indicated by arrow in FIG. 2.

FIGS. 3(A) and 3(B) are plan views of patterns of the first and second discharge electrodes $X_1$ through $X_m$ and $Y_1$ through $Y_m$ formed on the glass substrate 11A in another conventional ALIS-type plasma display device including the display panel 11. The X and Y directions of FIGS. 3(A) and 3(B) correspond to those of FIG. 1.

In FIG. 3(A), the first and second discharge electrodes $X_1$ through $X_m$ and $Y_1$ through $Y_m$ are formed of series of repeated T-shaped ITO patterns (electrodes) XT and YT extending from longitudinal sides of the corresponding bus electrodes $x_1$ through $x_m$ and $y_1$ through $y_m$ on the glass substrate 11A, respectively. Each ITO pattern has a tip part $T_A$ of a width A that extends in the extending direction of the bus electrodes $x_1$ through $x_m$ or $y_1$ through $y_m$ and a narrow neck part $T_B$ connecting the tip part $T_A$ and a corresponding one of the bus electrodes $x_1$ through $x_m$ or $y_1$ through $y_m$. Each adjacent ITO patterns are arranged with a pitch corresponding to the resolution of the display panel 11, for instance, a pitch of 300 $\mu$m in FIG. 3(A), and a discharge is sustained in a gap (discharge gap) of a width g formed between each opposed ITO patterns XT and YT.

FIG. 4 is a diagram showing a structure of the glass substrate 11B of FIG. 2.

In FIG. 4, ribs 11C are formed with given pitches on the glass substrate 11B to extend in the Y direction of FIG. 1. Grooves $G_1$ through $G_n$ are formed between the ribs 11C, and the address electrodes $Z_1$ through $Z_n$ are formed in the corresponding grooves $G_1$ through $G_n$. Further, the address electrodes $Z_1$ through $Z_n$ are covered with the dielectric film 11*b* in the corresponding grooves $G_1$ through $G_n$, and the fluorescent material patterns R, G, and B of red, green, and blue, respectively, are formed on the dielectric film 11*b*.

The glass substrate 11B of FIG. 4 is reversed to be placed on the glass substrate 11A so that, as shown in FIG. 5, the grooves $G_1$ through $G_n$ formed between the ribs 11C contain the corresponding ITO patterns XT and YT.

In the plasma display panel 11 of the above-described structure, a drive current for a discharge can be reduced by narrowing a width of the neck part $T_B$ of each ITO pattern XT or YT, and the discharge-sustaining voltage can be decreased by increasing the width A of the tip part $T_A$ of each ITO pattern XT or YT, or by decreasing the width g of the discharge gap.

If the plasma display panel 11 is to offer 1024×1024 resolution, letting its diagonal be 42 in., a pitch between each adjacent address electrodes $Z_1$ through $Z_n$ must be set to 300 μm. However, in the case of such a high-resolution plasma display panel, where each rib 11C has a width of 60 μm and the tip part $T_A$ of each ITO pattern XT or YT has the width A of 160 μm, each rib 11C and each ITO pattern XT or YT adjacent thereto are only slightly separated by a margin δ. Therefore, if a deviation between the positions between the glass substrates 11A and 11B exceeds the margin δ, each rib 11C, as shown in FIG. 6, overlaps the tip part $T_A$ of each adjacent ITO pattern XT or YT, thus reducing the width A of the tip part $T_A$.

SUMMARY OF THE INVENTION

It is a general object of the present invention to provide a plasma display device in which the above-described disadvantage is eliminated.

A more specific object of the present invention is to provide a high-resolution and low-power-consumption plasma display device that can be produced with a good fabrication yield.

The above objects of the present invention are achieved by a plasma display device having first and second substrates and a discharge gas filled therebetween, which plasma display device includes first and second electrodes extending parallel to each other on a first substrate, and first and second discharge electrode parts extending from the first and second electrodes, respectively, so as to oppose each other, wherein a discharge gap of a substantially constant width is formed between one of the first discharge electrode parts and one of the second discharge electrode parts, the ones opposing each other, the discharge gap being defined by first and second edge parts of the ones of the first and second discharge electrode parts, respectively, and the first and second edge parts have lengths longer than widths of the ones of the first and second discharge electrode parts, the widths being measured in directions in which the first and second electrodes extend, respectively.

According to the above-described plasma display device, at the same time that the effective length, that is, the length actually related to a discharge, of the edge part of each of the first and second discharge electrode parts is maintained so as to minimize a discharge starting voltage and a drive current for sustaining the discharge, the width of each of the first and second discharge electrode parts measured in the direction in which the first or second discharge electrode part extends can be smaller than the effective length of the edge part.

Additionally, in the above-described plasma display device, the discharge gap may have a length longer than or equal to 150 μm and shorter than 200 μm.

If the length of each of the first and second edge parts exceeds 200 μm, a discharge current increases while luminous efficacy decreases. Therefore, it is preferable to form the discharge gap of the constant width and the length longer than or equal to 150 μm and shorter than 200 μm between the ones of the first and second discharge electrode parts.

Further, in the above-described plasma display device, the discharge gap of the constant width and the length longer than or equal to 150 μm and shorter than 200 μm is formed between the ones of the first and second discharge electrode parts, and the first and second edge parts have the lengths longer than the widths of the ones of the first and second discharge electrode parts measured in the directions in which the first and second electrode parts extend, respectively. Therefore, if a pitch between each adjacent first or second discharge In electrode parts is narrowed, a sufficient margin can be secured therebetween. That is, according to the present invention, the plasma display device can be driven with a low voltage and low power consumption while eliminating a problem that some of the first and second discharge electrode parts may overlap ribs, or partition walls, formed on the second substrate because of an error in positioning the first and second substrates.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

[Principle]

Figure 7:
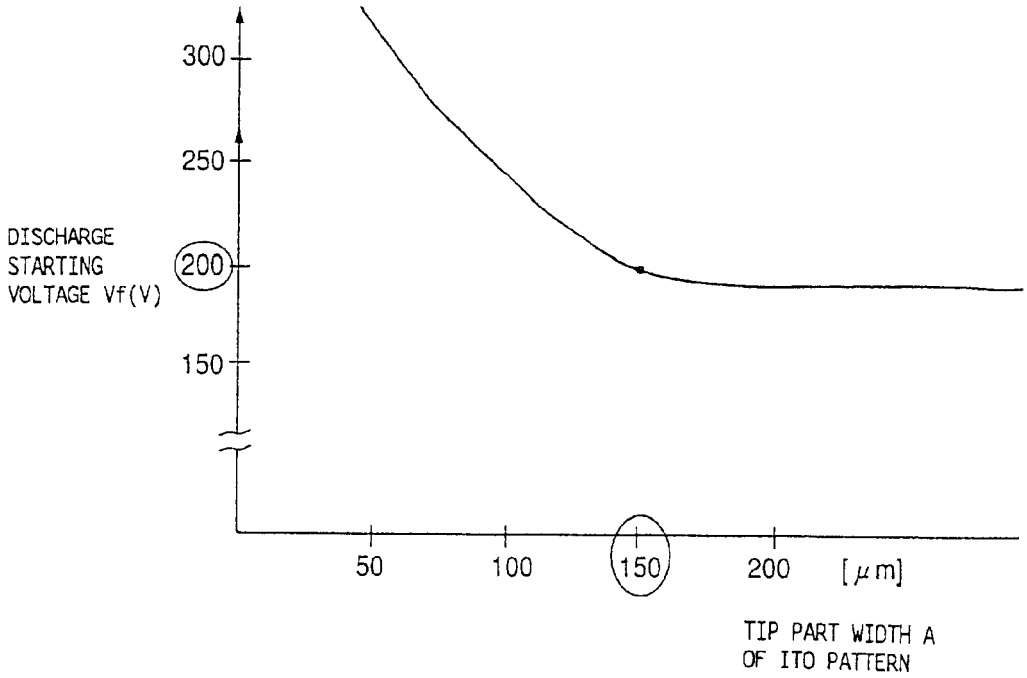
FIG. 7 is a diagram for illustrating a relation between a discharge starting voltage and a width of a tip part (an opposing edge part forming a discharge gap) of an ITO pattern in the plasma display panel of FIG. 2.

FIG. 7 is a diagram showing a relation between the width A of the tip part $T_A$ of each ITO pattern XT or YT and a discharge starting voltage Vf, which relation is discovered with respect to the plasma display panel 11 by the inventors of the present invention. In FIG. 7, the width g of each discharge gap is set to 100 μm.

Figure 6:
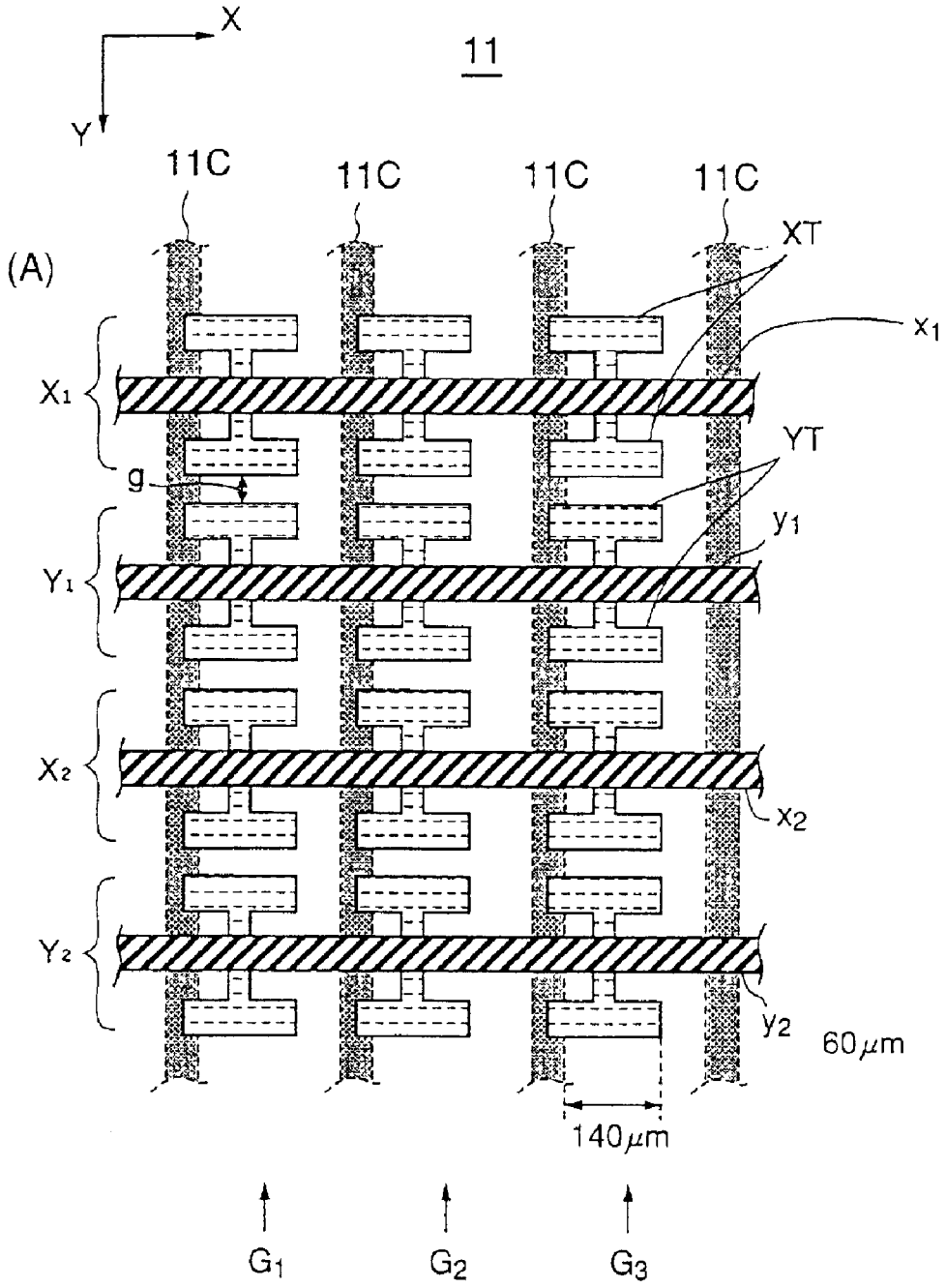
FIG. 6 PRIOR ART
FIG. 6 is a plan view of the plasma display panel of FIG. 2 for illustrating a problem caused therein.

According to FIG. 7, the discharge starting voltage Vf is almost constant at or below 200 V if the width A of the tip part $T_A$ is greater than or equal to 150 μm, while the discharge starting voltage Vf rises sharply as the width A decreases in a region where the width A is smaller than 150 μm. Thus, the relation shown in FIG. 7 indicates that the width A of the tip part $T_A$ must be set to 150 μm or greater to minimize the discharge starting voltage Vf. The width A can be smaller than 150 μm especially in such a case as shown in FIG. 6, but FIG. 7 shows that a discharge voltage is unavoidably increased in such a case. On the other hand, the discharge voltage can be decreased by decreasing the width g of the discharge gap to below 100 μm. In such a case, however, a discharge causes more damage to the tip part $T_A$, thus preventing the stable operation of the plasma display device 11.

A description will now be given, with reference to the accompanying drawings, of embodiments of the present invention.

[First embodiment]

Figure 8:
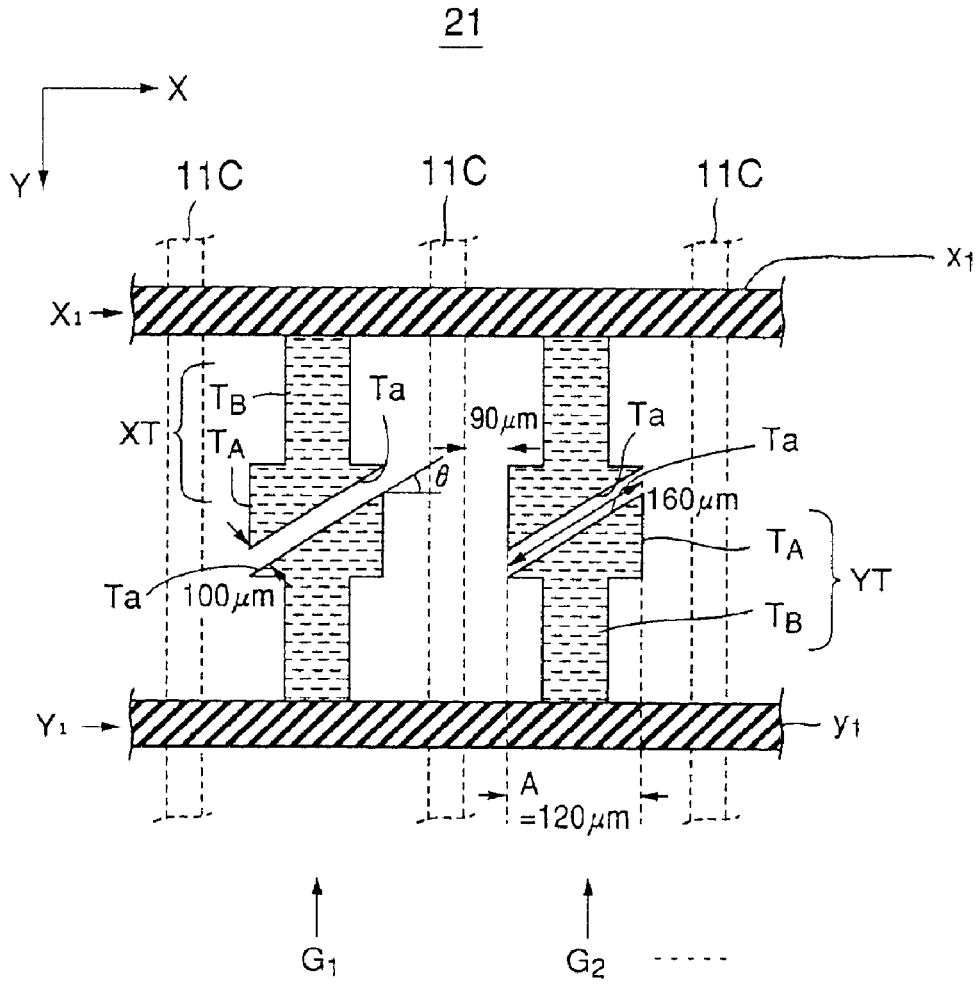
FIG. 8 is a diagram showing a structure of a plasma display panel according to a first embodiment of the present invention.

FIG. 8 is a diagram showing a structure of a plasma display panel 21 according to a first embodiment of the present invention. In FIG. 8, the same elements as those described previously are referred to by the same numerals, and a description thereof will be omitted.

Figure 1:
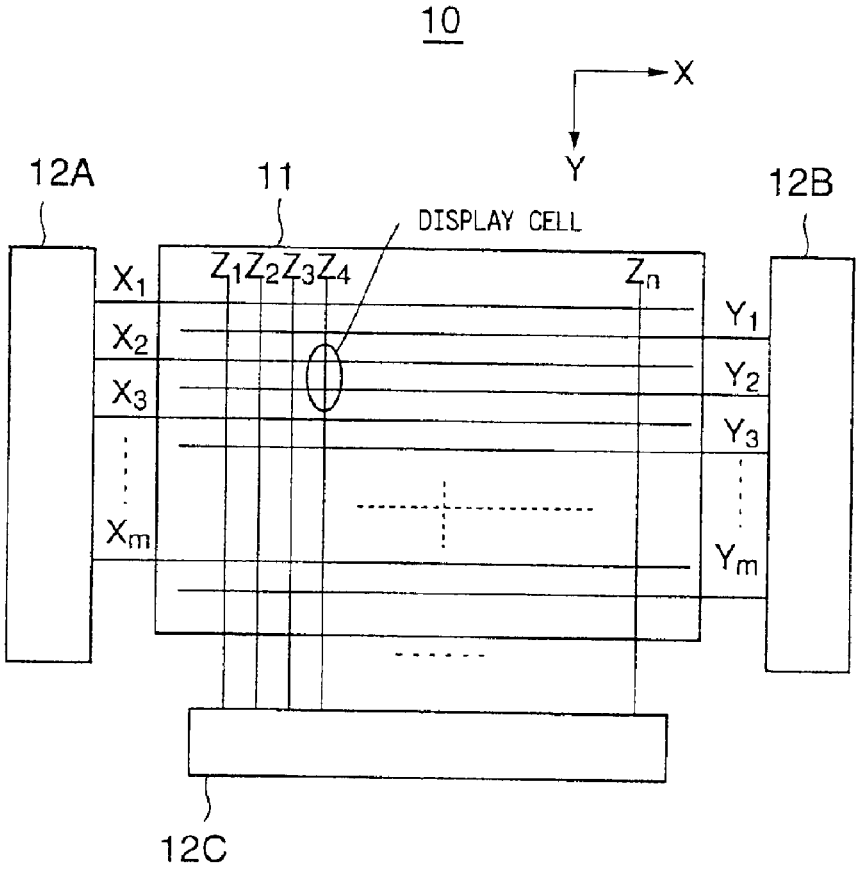
FIG. 1 PRIOR ART
FIG. 1 is a block diagram showing a schematic structure of a conventional plasma display device.
Figure 2:
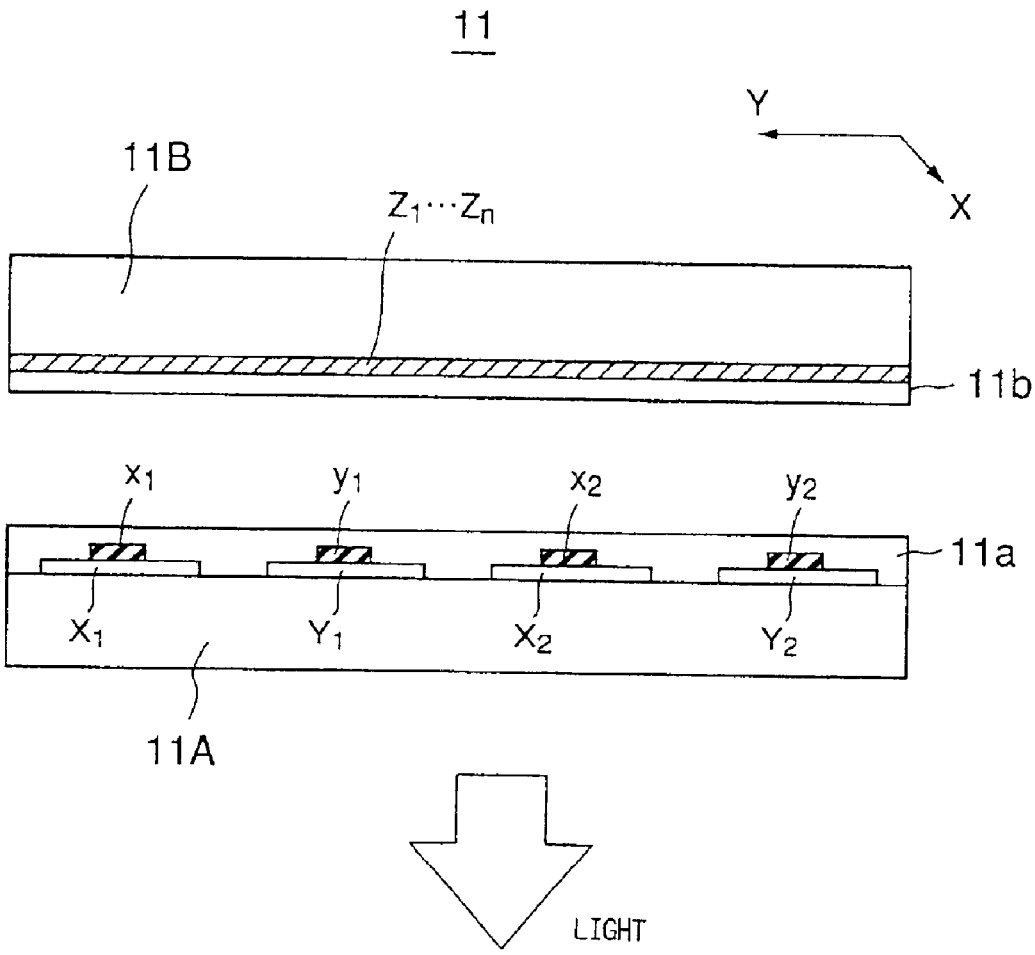
FIG. 2 PRIOR ART
FIG. 2 is a sectional view of a plasma display panel employed in the plasma display device of FIG. 1.
Figure 3A:
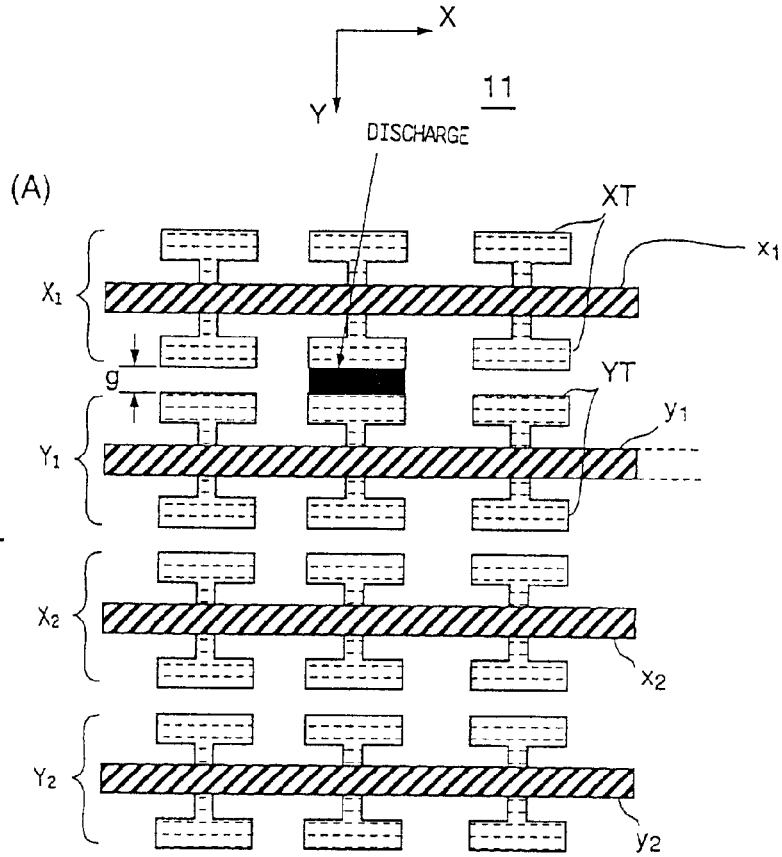
FIG. 3A PRIOR ART
FIGS. 3(A) and 3(B) are diagrams for illustrating a structure of electrodes formed on a display-side substrate of the plasma display panel of FIG. 2.
Figure 3B:
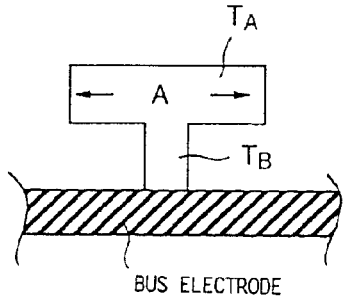
FIG. 3B PRIOR ART
Figure 4:
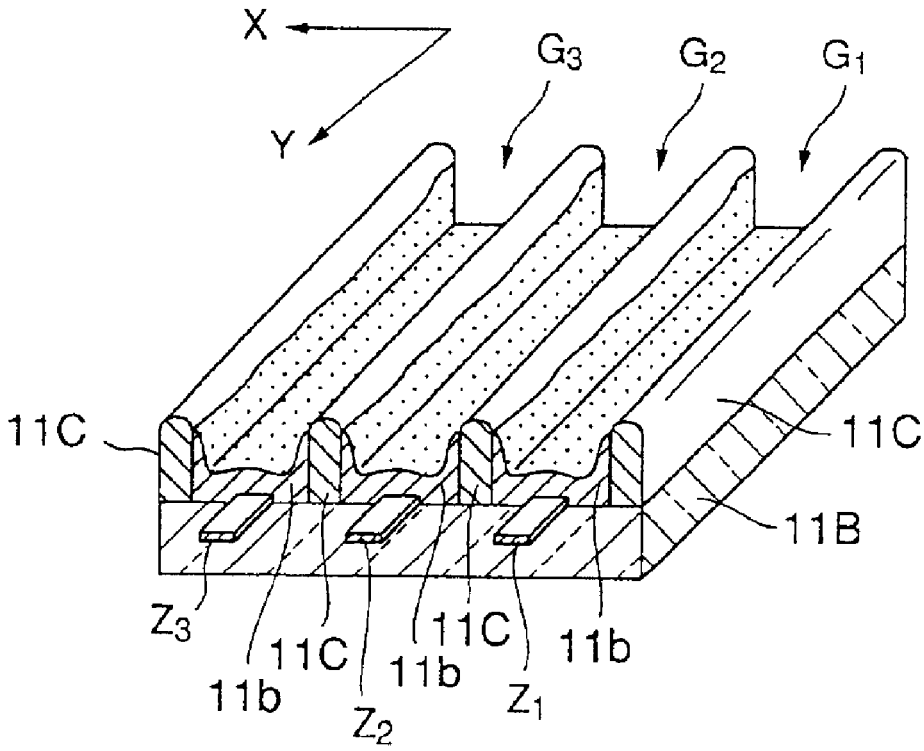
FIG. 4 PRIOR ART
FIG. 4 is a perspective view of a rear substrate of the plasma display panel of FIG. 2.
Figure 5:
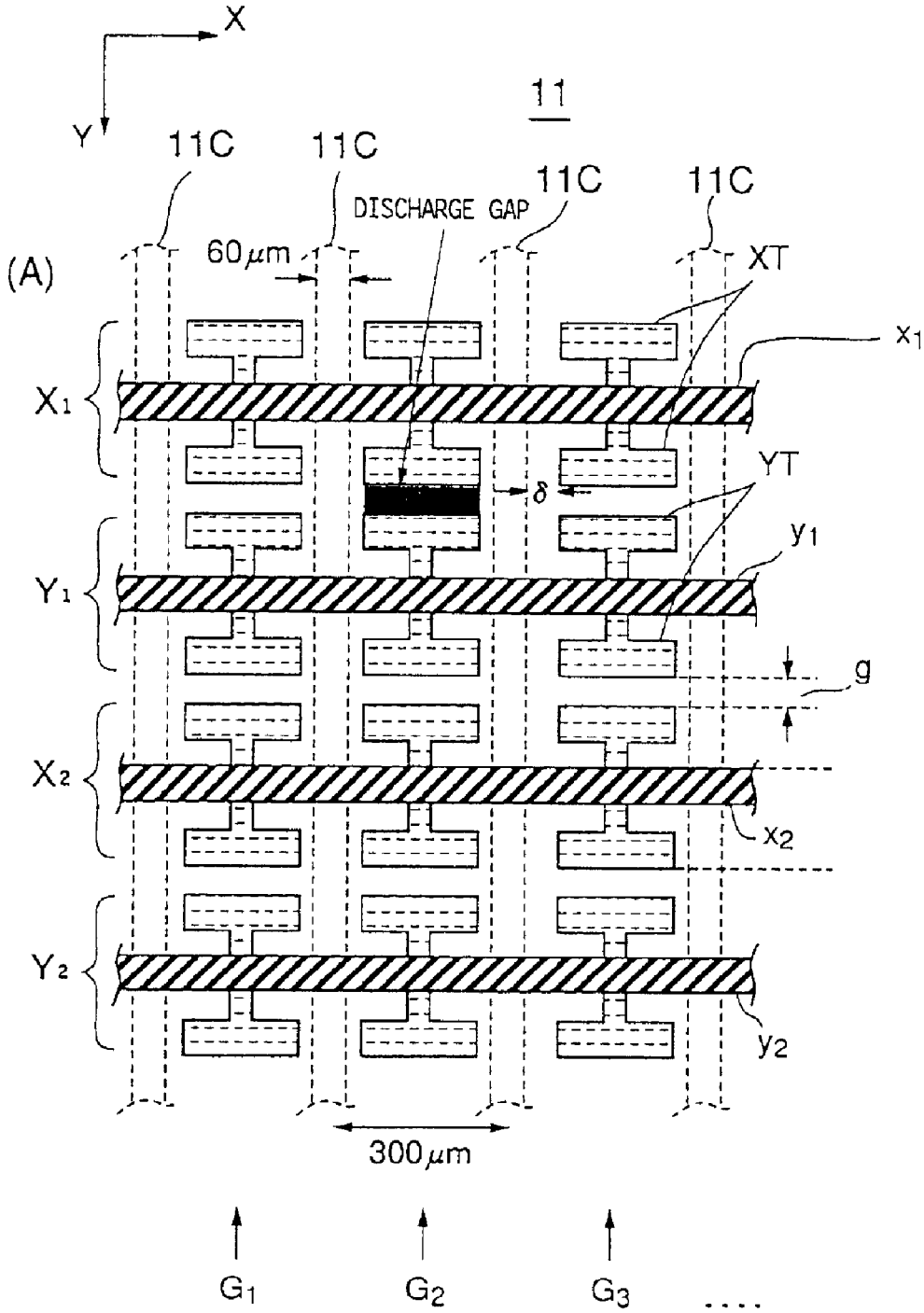
FIG. 5 PRIOR ART
FIG. 5 is a plan view of the plasma display panel of FIG. 2 for illustrating a relation between the electrodes and ribs.

In FIG. 8, the plasma display panel 21 replaces the plasma display panel 11 in the plasma display device 10 of FIG. 1. Like the plasma display panel 11, the plasma display panel 21 includes the ITO discharge electrodes XT extending from the bus electrode $x_1$ toward the bus electrode $y_1$ and the ITO discharge electrodes YT extending from the bus electrode $y_1$ toward the bus electrode $x_1$ so as to oppose the corresponding ITO discharge electrodes XT. The ITO discharge electrodes XT and YT are formed in the corresponding grooves $G_1$ through $G_n$ separated by the ribs 11C.

Each of the discharge electrodes XT and YT includes the tip part $T_A$ and the neck part $T_B$. In this embodiment, the width A of the tip part $T_A$ is reduced from conventional 160 to 120 μm so as to secure a (positioning) margin of 90 μm between each discharge electrode XT or YT and the rib 11C adjacent thereto as seen in FIG. 8. The pitch between adjacent ribs 11C is 2×90 (margin)+120 (width of tip part $T_A$) +2×30 (two halves of respective, adjacent ribs 11C)=360 microns.

On the other hand, in this embodiment, in order to avoid the problem of the increase of the discharge voltage resulting from the reduction of the width A of the tip part $T_A$, the tip part $T_A$ is defined by an oblique line part (edge part) $T_a$ forming an angle θ with the bus electrode $x_1$ or $y_1$. For instance, by setting the angle (inclination) θ of the oblique line part $T_a$ at 41°, the oblique line part $T_a$ is allowed to have a length of 160 μm. The angle θ is preferably set at greater than 30°. However, if the angle θ is set at such a great angle that the oblique line part $T_a$ has a length greater than 200 μm, a discharge current is increased while luminous efficacy is decreased. Therefore, the angle θ is preferably set at 60° or smaller.

In FIG. 8, the opposed discharge electrodes XT and YT extending from the bus electrodes $x_1$ and $y_1$ are disposed so that the oblique line parts $T_a$ of the discharge electrodes XT and YT form a discharge gap of 100 μm in width.

By this structure, at the same time that the width A of the tip part $T_A$ of each discharge electrode XT or YT is decreased, the tip part (edge part) $T_A$ where a discharge is actually caused can be ensured an optimum length or width that is greater than or equal to 150 μm and smaller than 200 μm. As a result, the problem of the increase of the discharge voltage and the accompanying increase of power consumption can be avoided.

[Second embodiment]

Figure 9:
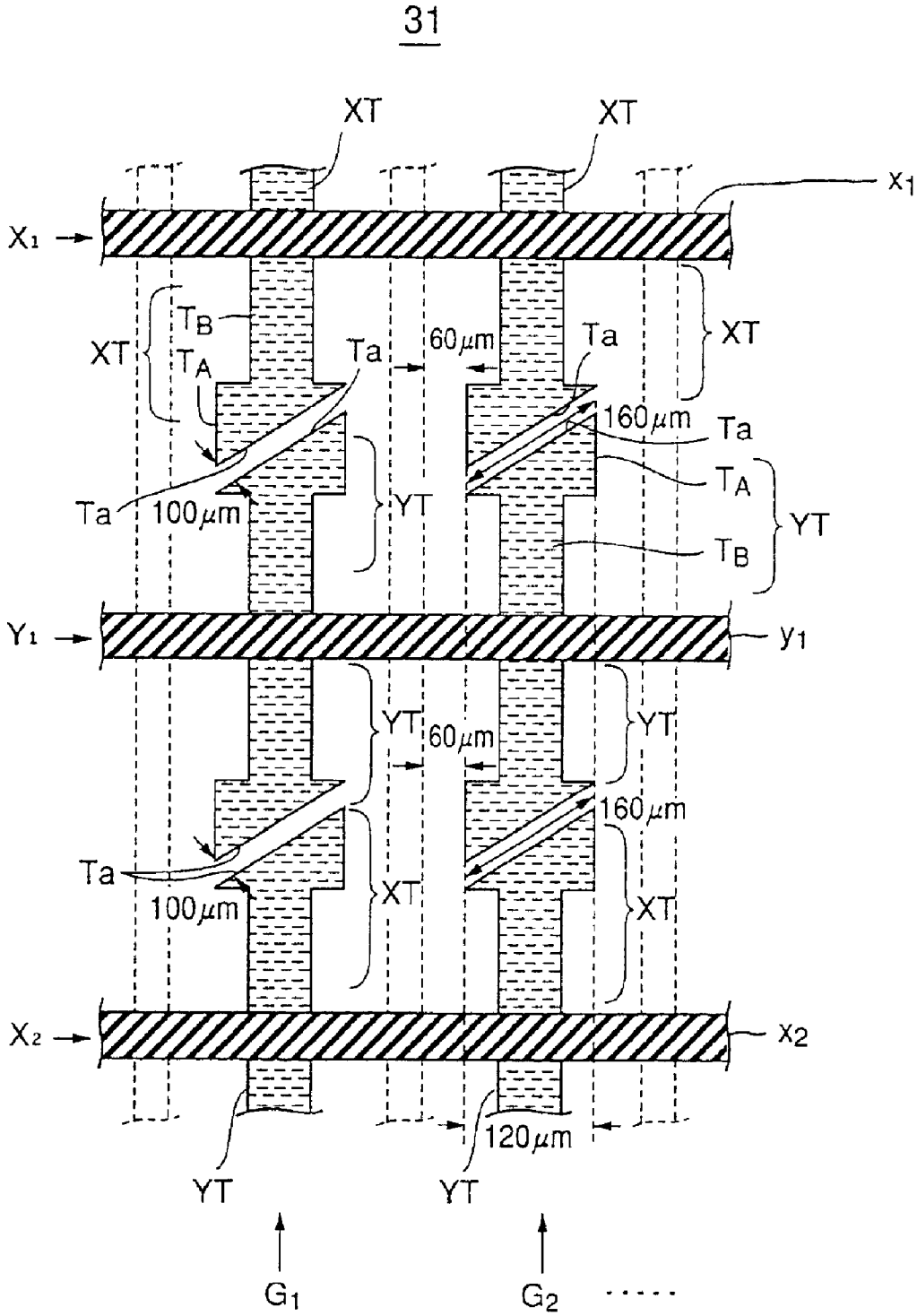
FIG. 9 is a diagram showing a structure of a plasma display panel according to a second embodiment of the present invention.

FIG. 9 is a diagram showing a structure of a plasma display panel 31 according to a second embodiment of the present invention. In FIG. 9, the same elements as those described previously are referred to by the same numerals, and a description thereof will be omitted.

According to FIG. 9, in this embodiment, in each of the grooves $G_l$ through $G_n$ separated by the ribs 11C, the discharge electrodes XT and YT extend from both sides of the bus electrodes $x_1$ and $Y_1$, respectively. FIG. 9 clearly shows that the minimum margin, between the tip part $T_A$ of each discharge electrode XT or YT and its adjacent rib 11C is 60 μm. Further, according to FIG. 9, the width of the tip cart $T_A$ is 120 μm, and the width of the rib 11C is 60 μm as explained in page 5, lines 17–18. Accordingly, the pitch between the ribs 11C (partition walls) is 60 (margin)×2+120 (tip part $T_A$ width) +2×30 (two halves of respective, adjacent ribs 11C. Therefore, the same electrode arrangement of the discharge electrodes XT and YT as that formed between the bus electrodes $x_1$ and $y_1$ is formed between the bus electrode bus electrode $Y_1$ and the bus electrode $x_2$ adjacent thereto.

In the plasma display panel 31 of the above-described structure, a discharge can be also caused between the bus electrodes $y_1$ and $x_2$ as between the bus electrodes $x_1$ and $y_1$. Therefore, the plasma display panel 31 can offer resolution twice that of a structure formed by repeating the electrode structure of FIG. 8.

[Third embodiment]

Figure 10:
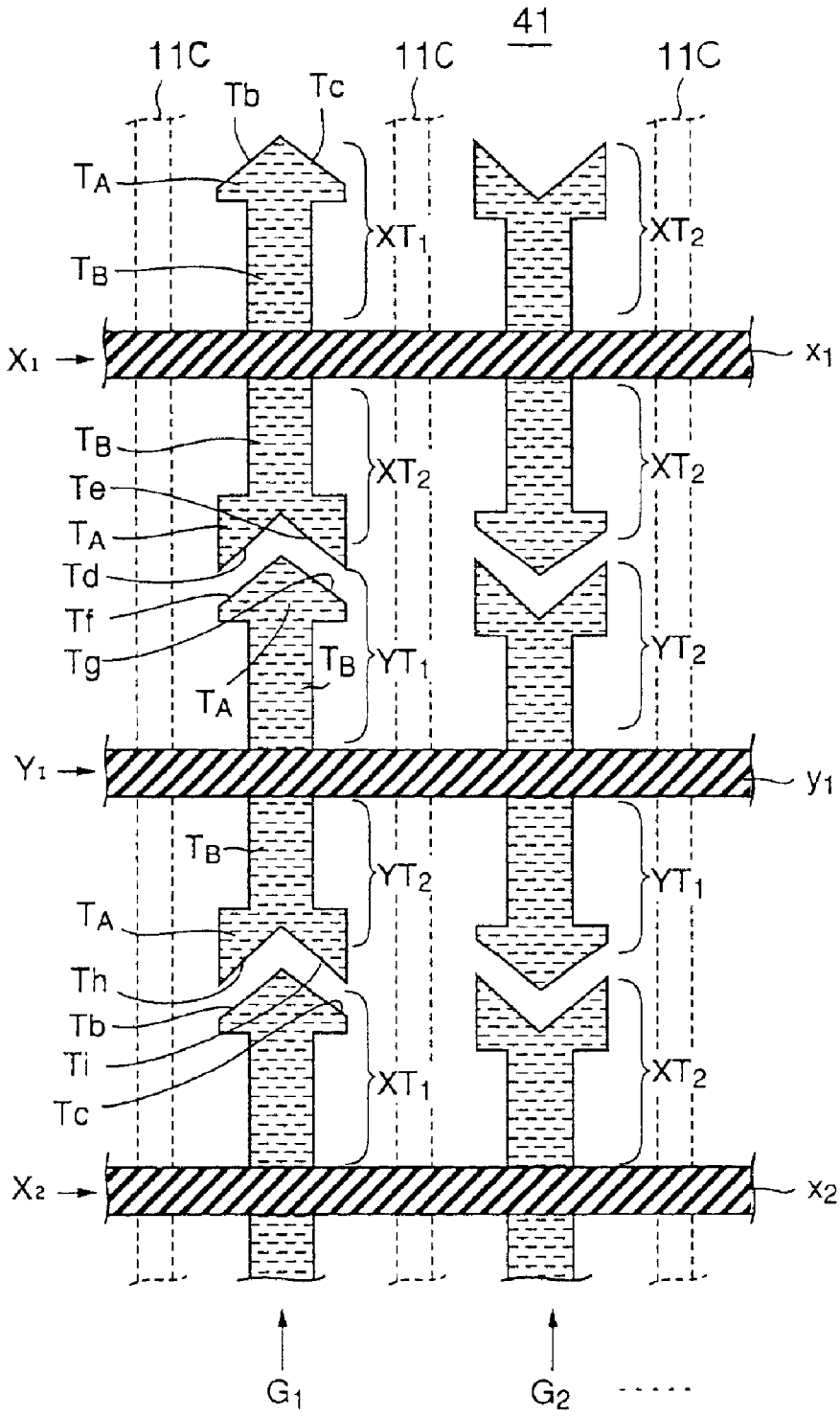
FIG. 10 is a diagram showing a structure of a plasma display panel according to a third embodiment of the present invention.

FIG. 10 is a diagram showing a structure of a plasma display panel 41 according to a fourth embodiment of the present invention. In FIG. 10, the same elements as those described previously are referred to by the same numerals, and a description thereof will be omitted.

According to FIG. 10, in this embodiment, each discharge electrode XT includes a discharge electrode $XT_1$ extending from the bus electrode $x_1$ in a first direction and a discharge electrode $XT_2$ extending from the bus electrode $x_1$ in a second direction opposite to the first direction. The discharge electrode $XT_1$ has a convex tip part $T_A$ defined by oblique line parts $T_b$ and $T_c$ (forming an edge part of the discharge electrode $XT_1$), while the discharge electrode $XT_2$ has a concave tip part $T_B$ defined by oblique line parts $T_d$ and $T_e$ (forming an edge part of the discharge electrode $XT_2$). Similarly, in this embodiment, each discharge electrode YT includes a discharge electrode $YT_1$ extending from the bus electrode $y_1$ toward the bus electrode $x_1$ and a discharge electrode $YT_2$ extending from the bus electrode $y_1$ in the opposite direction. The discharge electrode $YT_1$ has a convex tip part $T_A$ defined by oblique line parts $T_f$ and $T_g$ (forming an edge part of the discharge electrode $YT_1$), while the discharge electrode $YT_2$ has a concave tip part $T_B$ defined by oblique line parts $T_h$ and $T_i$ (forming an edge part of the discharge electrode $YT_2$). The same discharge electrodes are formed with respect to other bus electrodes not shown in the drawing.

The discharge electrodes $XT_1$, $YT_1$, $XT_2$, $YT_2$, . . . are formed along the groove $G_1$ defined by corresponding two of the ribs 11C and having the address electrode $Z_1$ formed therein. The discharge electrodes $XT_1$, $YT_1$, $XT_2$, $YT_2$, . . . are also formed in the adjacent groove $G_2$ but arranged in the reverse orientation.

In the structure shown in FIG. 10, the oblique line parts $T_d$ and $T_e$ of the discharge electrode $XT_2$ oppose the oblique line parts $T_f$ and $T_g$ of the discharge electrode $YT_1$, respectively, so that a discharge gap of approximately 100 μm is formed almost evenly therebetween. Similarly, the oblique line parts $T_b$ and $T_c$ of the discharge electrode $XT_1$ oppose the oblique line parts $T_h$ and $T_i$ of the discharge electrode $YT_2$, respectively, so that a discharge gap of approximately 100 μm is formed almost evenly therebetween.

In the plasma display panel 41 of the above-described structure, by forming, by the oblique line parts, the edge part of each of the discharge electrodes $XT_1$, $YT_1$, $XT_2$, and $YT_2$ which edge part defines the discharge gap, the total length of the edge part with respect to the given width A of the tip part $T_A$ can be made longer than in the above-described plasma display panel 21 or 31 whose discharge electrode XT or YT has its tip part $T_A$ formed to have the single oblique line part $T_a$. This also indicates that, if the total length of the edge part of each of the discharge electrodes $XT_1$, $YT_1$, $XT_2$, and $YT_2$ is set to a value within 150 to 200 μm, for instance, to 160 μm, a larger positioning margin can be secured than in the above-described embodiments by making the width A narrower than in the above-described embodiments.

[Fourth embodiment]

Figure 11:
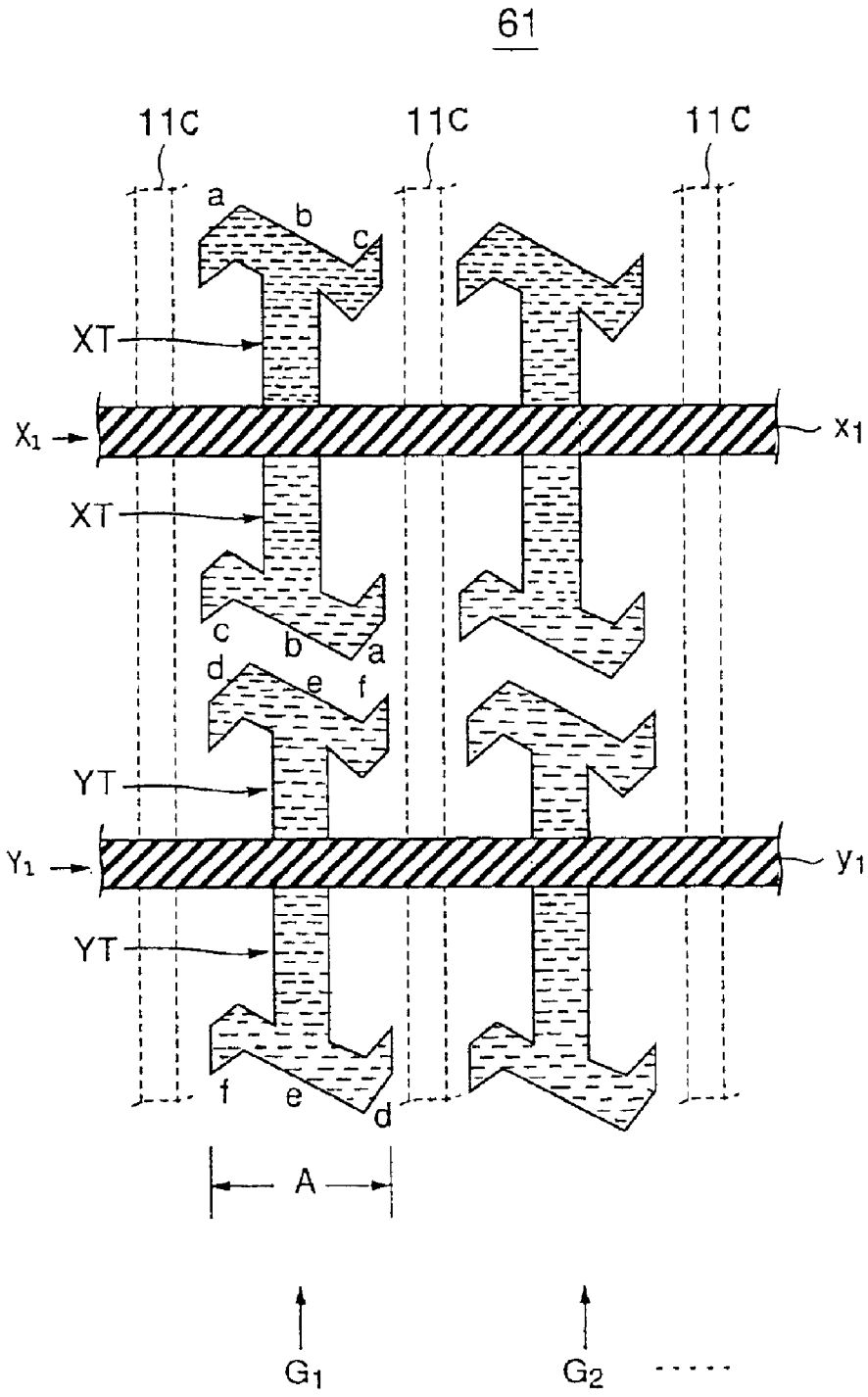
FIG. 11 is a diagram showing a structure of a plasma display panel according to a fourth embodiment of the present invention.

FIG. 11 is a diagram showing a structure of a plasma display panel 61 according to a fourth embodiment of the present invention. In FIG. 11, the same elements as those described previously are referred to by the same numerals, and a description thereof will be omitted.

According to FIG. 11, the plasma display panel 61 of this embodiment is a variation of the plasma display panel 41 of FIG. 10, and the edge part of each discharge electrode XT which part forms a discharge gap together with an opposing one of the discharge electrodes YT is defined by three oblique line parts a, b, and c. Similarly, the edge part of each discharge electrode YT which part forms a discharge gap together with an opposing one of the discharge electrodes XT is defined by three oblique line parts e, f, and d. This structure allows a discharge gap of approximately 100 μm to be formed almost evenly between each of the oblique line parts a and f, b and e, and c and d. If a patterning process permits, by providing each discharge electrode XT or YT with any complicated shape, it is possible to provide each discharge electrode XT or YT with an effective width of 160 μm while decreasing the width A of the tip part $T_A$.

In the above-described embodiments, the edge part of each discharge electrode has a width equal to or larger than 150 μm and a discharge gap of approximately 100 μm is formed between each pair of opposed discharge electrodes. However, these values are optimum values for the plasma display panels according to the present invention, and it is natural that these values should vary under different conditions of a material, a dielectric constant, a gas pressure, and a gas composition.

The present invention is not limited to the specifically disclosed embodiments, but variations and modifications may be made without departing from the scope of the present invention.

The present application is based on Japanese priority application No. 2000-266042 filed on Sep. 1, 2000, the entire contents of which are hereby incorporated by reference.

What is claimed is:

1. A plasma display device having first and second substrates and a discharge gas filled therebetween, the plasma display device comprising:

first and second electrodes extending in parallel to each other on the first substrate; and first and second discharge electrode parts extending from the first and second electrodes, respectively, so as to oppose each other; and a plurality of partition walls formed on the second substrate so as to extend perpendicularly to the first and second electrodes, the partition walls each separating an array of the first and second discharge electrode parts from an adjacent array of the first and second discharge electrode parts, wherein a discharge gap of a substantially constant width is formed between opposing, first and second discharge electrode parts, the discharge gap being defined by first and second edge parts of the opposing first and second discharge electrode parts, respectively;

the first and second edge parts have lengths longer than widths of the first and second discharge electrode parts, the widths being measured in directions in which the first and second electrodes extend, respectively;

the first edge part forms an angle θ with respect to the direction in which the first electrode extends, the angle θ satisfying a condition: $30° \leqq \theta \leqq 60°$; and the width of each of the first and second discharge electrode parts is 120 μm or less; and the first and second discharge electrode parts extend toward each other in parallel with, but not overlapping, the partition walls.

2. The plasma display device as claimed in claim 1, wherein the discharge gap has a length longer than or equal to 150 μm and shorter than 200 μm.

3. The plasma display device as claimed in claim 1, wherein:

the first edge part extends obliquely with respect to the direction in which the first electrode extends; and the second edge part extends substantially parallel to the first edge part and obliquely with respect to the direction in which the second electrode extends.

4. The plasma display device as claimed in claim 1, wherein the first and second edge parts are defined by a plurality of sides forming angles with respect to the direction in which the first and second electrode extend, respectively.

5. The plasma display device as claimed in claim 1, wherein:

the first edge part has a convex shape; and the second edge part has a concave shape matching the first edge part.

6. The plasma display device as claimed in claim 1, wherein:

the first and second electrodes are repeatedly formed alternately; and the first discharge electrode parts extend from first and second parallel sides of the first electrode and the second discharge electrode parts extend from first and second parallel sides of the second electrode.

7. The plasma display device as claimed in claim 6, wherein each of the first discharge electrode parts includes first and second electrode patterns extending from the first and second sides of the first electrode, respectively, the first electrode pattern forming a first discharge gap with one of the second discharge electrode parts which one opposes the first electrode pattern, the second electrode pattern forming a second discharge gap with one of the second discharge electrode parts which one opposes the second electrode pattern, the second discharge gap being substantially equal to the first discharge gap in size.

8. The plasma display device as claimed in claim 1, wherein:

the discharge gap has a length longer than or equal to 150 μm and shorter than 200 μm;

a gap formed between each of the first and second discharge electrodes parts and the partition wall adjacent thereto is 90 μm or greater; and the partition walls are formed with a pitch of 360 μm.

9. The plasma display device as claimed in claim 8, wherein the width of the discharge gap is 100 μm.

10. The plasma display device as claimed in claim 1, wherein:

the discharge gap has a length longer than or equal to 150 μm and shorter than 200 μm;

a gap formed between each of the first and second discharge electrode parts and the partition wall adjacent thereto is 60 μm or greater; end the partition walls are formed with a pitch of 300 μm.

11. A plasma display device having first and second substrates and a discharge gas filled therebetween, comprising:

first and second electrodes extending in parallel to each other on the first substrate; and first and second discharge electrode parts extending from the first and second electrodes, respectively, so as to oppose each other; and a plurality of partition walls formed on the second substrate so as to extend perpendicularly to the first and second electrodes, the partition walls each separating an array of the first and second discharge electrode parts from an adjacent array of the first and second discharge electrode parts, wherein:

a discharge gap of a substantially instant width is formed between the opposing first and second discharge electrode parts, the discharge gap being defined by first and second edge parts of the opposing first and second discharge electrode parts, respectively;

the first and second edge parts have lengths longer than widths of the opposing first and second discharge electrode parts, the widths being measured in respective directions in which the first and second electrodes extend;

the first and second edge parts are defined by a plurality of straight line segments forming angles with respect to the respective directions in which the first and second electrodes extend;

the first and second discharge electrode parts extend toward each other in parallel with, but not overlapping, the partition walls;

the discharge gap has a length longer than or equal to 150 μm and shorter than 200 μm;

a gap formed between each of the first and second discharge electrode parts and the partition wall adjacent thereto is 90 μm or over; and the partition walls are formed with a pitch of 360 μm.

12. The plasma display device as claimed in claim 11, wherein the width of the discharge gap is 100 μm.

13. The plasma display device as claimed in claim 11, wherein:

each of the first and second edge parts comprises a tip part having angularly bent ends; and each of the first and second edge parts comprises a plurality of oblique lines of the tip part.

14. A plasma display device having first and second substrates and a discharge gas filled therebetween, comprising:

first and second electrodes extending in parallel to each other on the first substrate; and first and second discharge electrode parts extending from the first and second electrodes, respectively, so as to oppose each other; and a plurality of partition walls formed on the second substrate so as to extend perpendicularly to the first and second electrodes, the partition walls each separating an array of the first and second discharge electrode parts from an adjacent array of the first and second discharge electrode parts, wherein:

a discharge gap of a substantially constant width is formed between the opposing first and second discharge electrode parts, the discharge gap being defined by first and second edge parts of the opposing first and second discharge electrode parts, respectively;

the first and second edge parts have lengths longer than widths of the opposing first and second discharge electrode parts, the widths being measured in respective directions in which the first and second electrodes extend;

the first and second edge parts are defined by a plurality of straight line segments forming angles with respect to the respective directions in which the first and second electrodes extend;

the first and second discharge electrode parts extend toward each other in parallel with, but not overlapping, the partition walls;

the discharge gap has a length longer than or equal to 150 μm and shorter than 200 μm;

a gap formed between each of the first and second discharge electrode parts and the partition wall a-adjacent thereto is 60 μm or greater; and the partition walls are formed with a pitch of 300 μm.

15. The plasma display device as claimed in claim 14, wherein:

each of the first and second edge parts comprises a tip part having angularly bent ends; and each of the first and second edge parts comprises a plurality of oblique lines of the tip part.

16. A plasma display device having first and second substrates and a discharge gas filled therebetween, the plasma display device comprising:

first and second electrodes extending in parallel to each other on the first substrate; and first and second discharge electrode parts extending from the first and second electrodes, respectively, so as to oppose each other; and a plurality of partition walls formed on the second substrate so as to extend perpendicularly to the first and second electrodes, the partition walls each generating an array of the first and second discharge electrode parts from an adjacent array of the first and second discharge electrode parts, wherein:

a discharge gap of a substantially constant width is formed between first and second discharge electrode parts, the discharge gap being defined by first and second edge parts of the opposing first and second discharge electrode parts, respectively, the first and second edge parts have lengths longer than widths of the first and second discharge electrode parts, the widths being measured in respective directions in which the first and second electrodes extend, the first edge part forms an angle θ with respect to the direction in which the first electrode extends, the angle θ satisfying a condition $30° \leqq \theta \leqq 60°$, each of the first and second edge parts comprises a single straight line or a plurality of straight line segments and is of a rectilinear configuration so that a distance between the first and second edge parts is substantially uniform; and the first and second discharge electrode parts extend toward each other in parallel with, but not overlapping, the partition walls, each of the first and second discharge electrode parts comprises a tip part having a substantially right triangular shape; and each of the first and second edge parts is a hypotenuse of the tip part.

17. A plasma display device having first and second substrates and a discharge gas filled therebetween, the plasma display device comprising:

first and second electrodes extending parallel to each other on the first substrate; and first and second discharge electrode parts extending from the first and second electrodes, respectively, so as to oppose each other; and a plurality of partition walls formed on the second substrate so as to extend perpendicularly to the first and second electrodes, the partition walls each separating an array of the first and second discharge electrode parts from an adjacent array of the first and second discharge electrode parts, wherein;

a discharge gap of a substantially constant width is formed between first and second discharge electrode parts, the discharge gap being defined by first and second edge parts of the opposing first and second discharge electrode parts, respectively the first and second edge parts have lengths longer than widths of the first and second discharge electrode parts, the widths being measured in respective directions in which the first and second electrodes extend, the first edge part forms an angle $\theta$ with respect to the direction in which the first electrode extends, the angle $\theta$ satisfying a condition $30° \leqq \theta \leqq 60°$.

each of the first and second and parts comprises single straight line or a plurality of straight line segments, and is of a rectilinear configuration so that a distance between the first and second edge parts is substantially uniform, the first and second discharge electrode parts extend toward each other in parallel with, but not overloading, the partition walls, the first discharge electrode part comprises a first tip part having a convex shape and the second discharge electrode part comprises a second tip part having a concave shape, and the first edge part comprises a plurality of oblique lines of the first tip part and the second edge part comprises a plurality of oblique lines of the second tip part.

* * * * *

UNITED STATES PATENT AND TRADEMARK OFFICE

CERTIFICATE OF CORRECTION

PATENT NO. : 6,936,966 B2
APPLICATION NO. : 09/936966
DATED : August 30, 2005
INVENTOR(S) : Yoshikazu Kanazawa et al.

It is certified that error appears in the above-identified patent and that said Letters Patent is hereby corrected as shown below:

On the title page, item [56]:

Column 2 (Foreign Patent Documents), Line 5, delete "2001-195431" and insert -- 2000-195431 -- therefor.
Column 9, Line 9, delete "end" and insert -- and -- therefor.
Column 9, Line 26, delete "instant" and insert -- constant -- therefor.
Column 10, Line 26, delete "a-adjacent" and insert -- adjacent -- therefor.
Column 10, Line 44, delete "generating" and insert -- separating -- therefor.
Column 11, Line 9, after "extending" insert -- in --.
Column 11, Line 20, after "wherein" delete ";" and insert -- : -- therefor.
Column 11, Line 25, after "respectively" insert -- , -- therefor.
Column 12, Line 7, after "60°" delete "." and insert -- , -- therefor.
Column 12, Line 8, after "second" delete "and" and insert -- edge -- therefor.
Column 12, Line 15, delete "overloading" and insert -- overlapping -- therefor.

Signed and Sealed this

Eighth Day of August, 2006

JON W. DUDAS
*Director of the United States Patent and Trademark Office*